US009677506B2

(12) United States Patent
Bostian et al.

(10) Patent No.: US 9,677,506 B2
(45) Date of Patent: Jun. 13, 2017

(54) CARBURETOR SUPPLEMENTAL FUEL SUPPLY

(71) Applicant: WALBRO ENGINE MANAGEMENT, L.L.C., Tucson, AZ (US)

(72) Inventors: Scott D. Bostian, Kingston, MI (US); Matthew A. Braun, Caro, MI (US); Gary J. Burns, Fostoria, MI (US)

(73) Assignee: Walbro LLC, Tucson, AZ (US)

( * ) Notice: Subject to any disclaimer, the term of this patent is extended or adjusted under 35 U.S.C. 154(b) by 123 days.

(21) Appl. No.: 14/423,611

(22) PCT Filed: Sep. 25, 2013

(86) PCT No.: PCT/US2013/061578

§ 371 (c)(1),
(2) Date: Feb. 24, 2015

(87) PCT Pub. No.: WO2014/052385

PCT Pub. Date: Apr. 3, 2014

(65) Prior Publication Data

US 2015/0184616 A1 Jul. 2, 2015

Related U.S. Application Data

(60) Provisional application No. 61/706,973, filed on Sep. 28, 2012.

(51) Int. Cl.
*F02M 7/00* (2006.01)
*F02M 17/04* (2006.01)
(Continued)

(52) U.S. Cl.
CPC ..... *F02M 17/04* (2013.01); *B01F 3/04985* (2013.01); *B01F 15/0479* (2013.01);
(Continued)

(58) Field of Classification Search
CPC F02M 1/16; F02M 17/04; F02M 7/06; F02M 7/08
(Continued)

(56) References Cited

U.S. PATENT DOCUMENTS 6,533,254 B1 * 3/2003 Grifka ..... F02M 1/16 123/179.11
2005/0109303 A1 5/2005 Oyamada et al.
(Continued)

FOREIGN PATENT DOCUMENTS

JP 2009235905 10/2009

OTHER PUBLICATIONS

Written Opinion & International Search Report for PCT/US2013/061578, mailed Dec. 17, 2013, 11 pages.

*Primary Examiner* — Robert A Hopkins
(74) *Attorney, Agent, or Firm* — Reising Ethington P.C.

(57) ABSTRACT

A carburetor provides a supplemental fuel supply to an engine and includes a body, a fuel metering diaphragm and a fluid pump. The fuel metering diaphragm defines part of a fuel metering chamber and a reference chamber and has at least a portion that is movable relative to the body to increase and decrease the volume of the fuel metering chamber to control fuel flow in the fuel metering chamber. The fluid pump is carried by the carburetor or another component upstream of the carburetor and has an outlet in fluid communication with the metering reference chamber and an actuator arranged to discharge fluid through the outlet to increase the pressure within the metering reference chamber and thereby increase the fuel flow rate from the fuel metering chamber to the air-fuel passage to provide a supplemental fuel supply to the engine.

19 Claims, 3 Drawing Sheets

(51) Int. Cl.

| | |
|---|---|
| ***F02M 7/08*** | (2006.01) |
| ***F02M 1/16*** | (2006.01) |
| ***B01F 3/04*** | (2006.01) |
| ***B01F 15/04*** | (2006.01) |

(52) U.S. Cl.
CPC ..... *F02M 1/16* (2013.01); *F02M 7/00* (2013.01); *F02M 7/08* (2013.01); *B01F 2215/0086* (2013.01)

(58) Field of Classification Search
USPC ..... 261/34.1, 35, 36.2, 66, DIG. 8, DIG. 68; 123/179.11
See application file for complete search history.

(56) References Cited

U.S. PATENT DOCUMENTS

| | | | |
|---|---|---|---|
| 2007/0013085 | A1 | 1/2007 | Araki |
| 2008/0061454 | A1 | 3/2008 | Braun |
| 2008/0163841 | A1 | 7/2008 | Gliniecki et al. |
| 2011/0006446 | A1 | 1/2011 | Abe et al. |

* cited by examiner

CARBURETOR SUPPLEMENTAL FUEL SUPPLY

TECHNICAL FIELD

The present disclosure relates generally to a carburetor and more particularly to a supplemental fuel supply in a carburetor.

BACKGROUND

Some small internal combustion engines for handheld power tools such as chain saws, grass trimmers, weed trimmers, leaf blowers, scooters, mopeds, motorcycles and other applications have carburetors that supply a combustible fuel and air mixture to the operating engine. The fuel and air mixture and/or the relative flow rate of the mixture may not be ideal over all operating conditions of the engine. For example, some engines may need additional fuel or a richer fuel/air mixture during acceleration, upon starting or in other conditions.

SUMMARY

A carburetor provides a supplemental fuel supply to an engine and includes a body, a fuel metering diaphragm and a fluid pump. The body has an air-fuel passage from which a fuel and air mixture flows from the carburetor, and a fuel metering chamber from which fuel flows to the air-fuel passage. The fuel metering diaphragm defines part of the fuel metering chamber and has at least a portion that is movable relative to the body to increase and decrease the volume of the fuel metering chamber to control fuel flow in the fuel metering chamber, the fuel metering diaphragm also defining part of a metering reference chamber that is separate from the fuel metering chamber. And the fluid pump is carried by the carburetor or by another component upstream of the carburetor relative to the direction of air flow through the carburetor and has an outlet in fluid communication with the metering reference chamber and an actuator arranged to discharge fluid through the outlet to increase the pressure within the metering reference chamber and thereby increase the fuel flow rate from the fuel metering chamber to the air-fuel passage to provide a supplemental fuel supply to the engine.

In at least some implementations, a carburetor provides a supplemental fuel supply to an engine and has a body, a pressure signal passage, a fuel metering diaphragm and a pump diaphragm. The body has an air-fuel passage from which a fuel and air mixture flows from the carburetor, and a fuel metering chamber from which fuel flows to the air-fuel passage. The pressure signal passage communicates with an engine pressure signal source and routes a pressure signal to the pump diaphragm. The fuel metering diaphragm defines part of the fuel metering chamber and part of a metering reference chamber that is separate from the fuel metering chamber. The fuel metering diaphragm has a portion that moves relative to the body. And the pump diaphragm may be carried by the carburetor to define, with a portion of the carburetor body or another component of the carburetor, a pump chamber on one side of the pump diaphragm and a reference chamber on the opposite side of the pump diaphragm that is communicated with the pressure signal passage. The pump chamber has an outlet that is in fluid communication with the metering reference chamber and the pump diaphragm is flexed in response to a pressure signal from the pressure signal passage to vary the volume of the pump chamber and selectively move air from the pump chamber through the outlet to increase the pressure within the metering reference chamber and thereby increase the fuel flow rate from the fuel metering chamber to the air-fuel passage.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
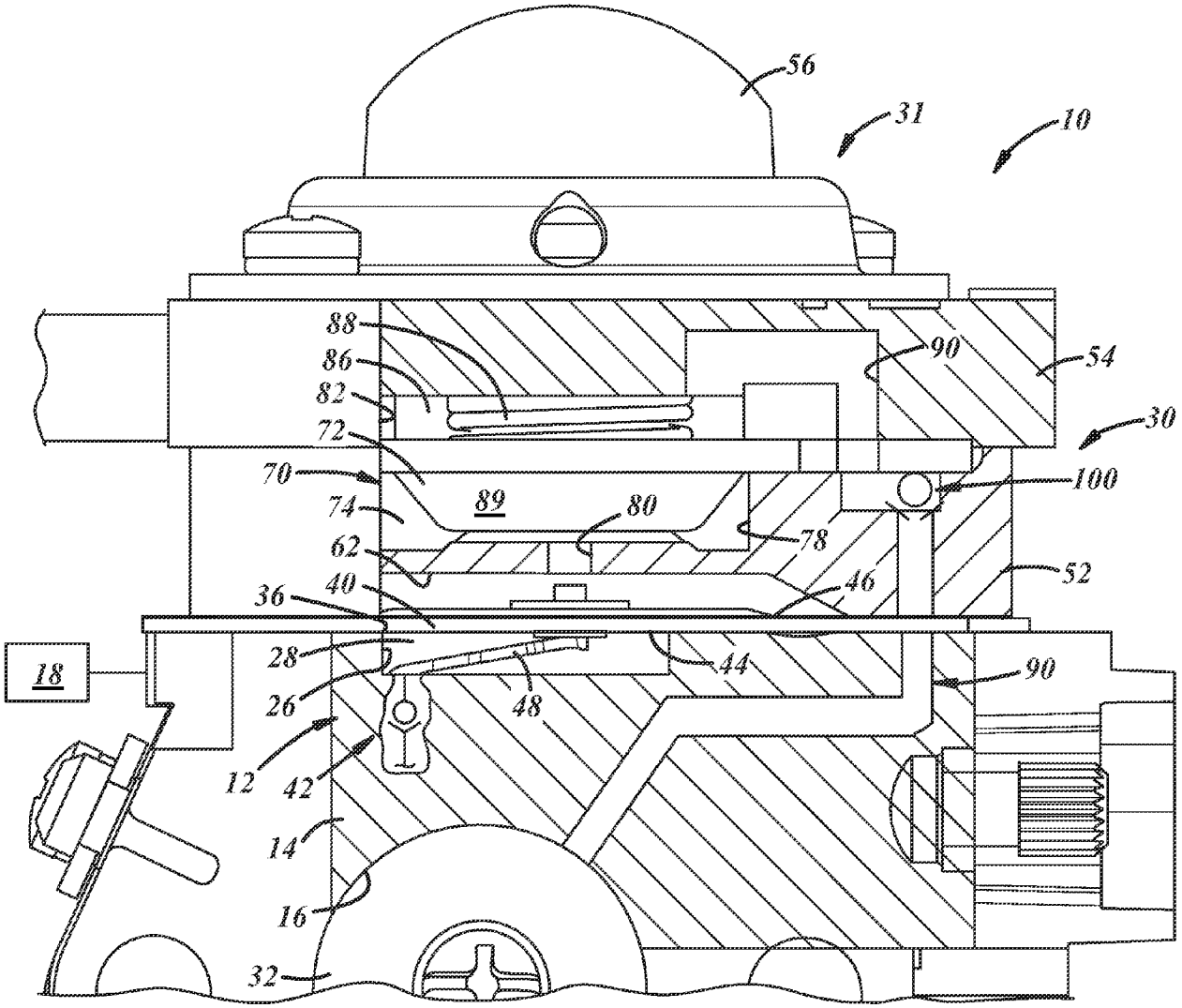
FIG. 1 is a fragmentary sectional view of a carburetor including a pump communicated with a fuel metering system.
Figure 2:
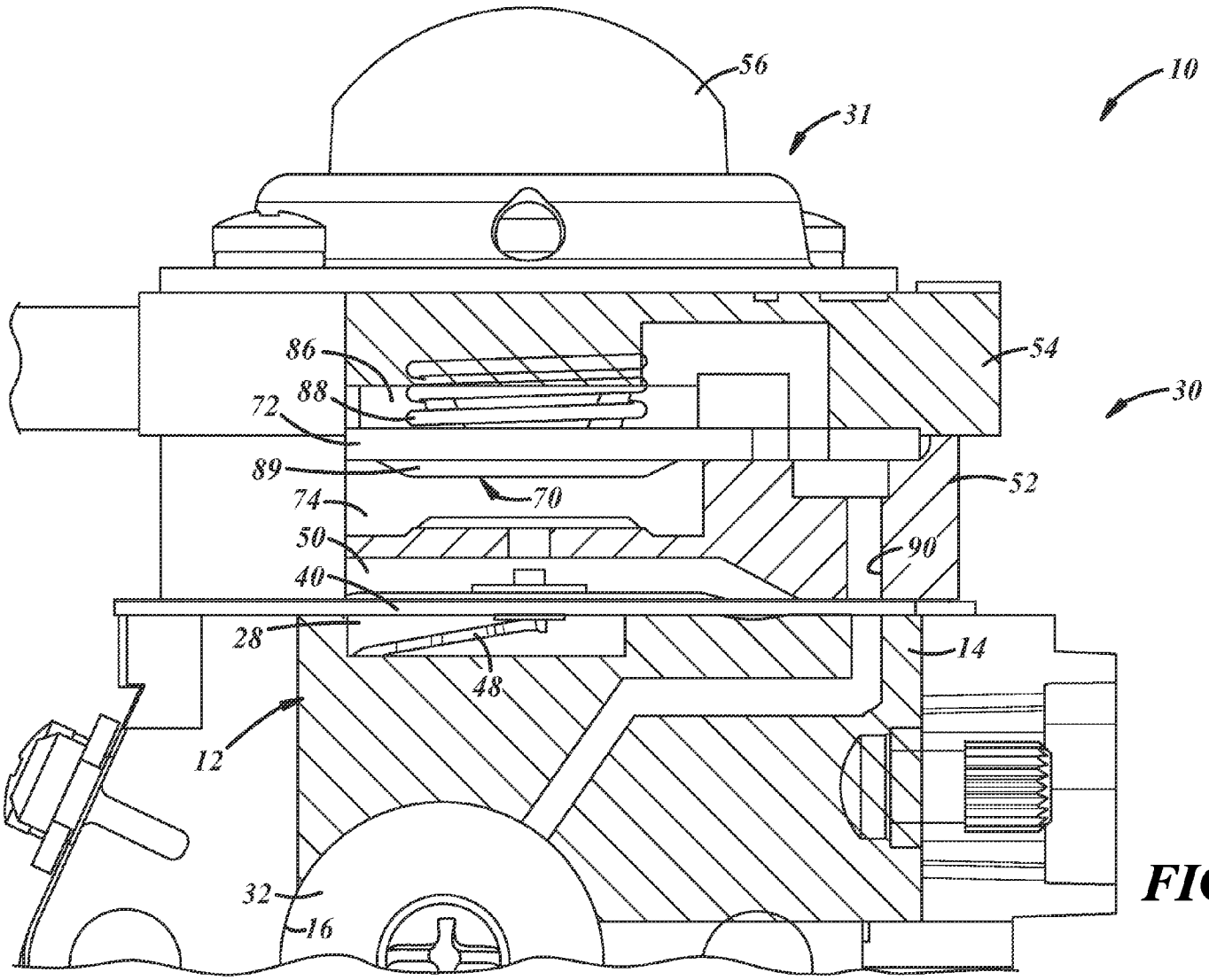
FIG. 2 is a fragmentary sectional view like FIG. 1 showing a diaphragm of the pump in a second position.
Figure 3:
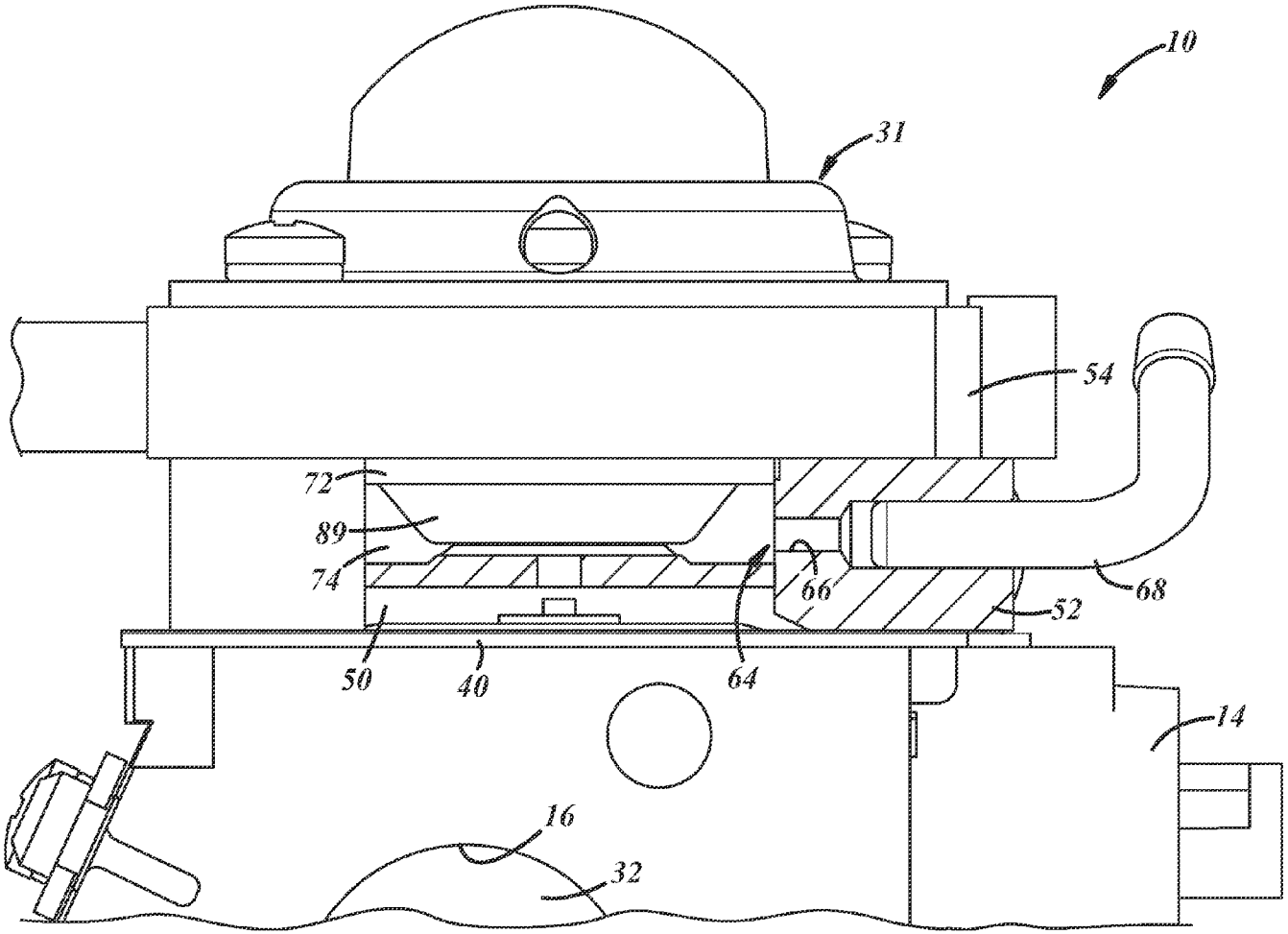
FIG. 3 is a fragmentary sectional view showing a vent passage for a pump chamber of the pump.

Referring in more detail to the drawings, FIGS. 1-3 illustrate a carburetor 10 that may be used to provide a combustible charge of an air and fuel mixture to an engine (not shown). For example, the engine may be any suitable two or four-stroke engine, which may include one or more cylinders with up to about 120 cc displacement for handheld or ground supported equipment such as hedge trimmers, grass trimmers, chainsaws, earth compactors and other devices. Of course, other engine types and sizes may be utilized.

Referring in more detail to the drawings, FIG. 1 is a cross-sectional view of a carburetor 10 with a diaphragm metering system 12. Many of the individual components and arrangement of components in FIG. 1 are shown schematically for illustration purposes—i.e., the cross-section does not necessarily represent a planar cross-section through an operable carburetor and may omit one or more carburetor components or features. The carburetor 10 includes a body 14 and an air-fuel passage 16 formed through the body. The body 14 supports a fuel metering system 12, which is constructed and arranged to help control fuel flow from a fuel source to the air-fuel passage 16. In this particular embodiment, the fuel source is an onboard fuel pump (not shown) which may include a separate diaphragm as is known to those skilled in this art. The fuel pump may be a diaphragm type fuel pump or any other type of fuel pump capable of providing and/or pressurizing fuel. Also, the fuel source may simply be a port in the carburetor body arranged for connection with gravity-fed fuel, in a different embodiment.

In the illustrated embodiment, the carburetor body 14 includes a recess 26 in an outer surface of the carburetor body 14 to partly define a metering chamber 28. The carburetor 10 may include other components or features such as a cover 30, purge/primer assembly 31, a throttle valve 32, as well as other components not shown. For example, the carburetor may include one or more fluid passages, a choke mechanism, among other things. The illustrated passages are only representative and may each comprise multiple individually formed passages to allow fluid flow between respective portions of the carburetor.

The metering system 12 includes a metering diaphragm 40 and a metering valve 42 actuated by the metering diaphragm to control fuel delivery from the metering system 12. Only a portion of the valve 42 is shown in the drawings.

The metering system 12 may be constructed substantially as shown in U.S. Pat. No. 7,467,785, the disclosure of which is incorporated herein by reference. The metering diaphragm 40 has a metering chamber side 44 and an opposite reference side 46. The chamber side 44 and the carburetor body 14 together form the metering chamber 28. The metering diaphragm 40 is attached to the carburetor body 14 to form a fluid tight seal about a periphery 36 of the metering chamber 28, and between the carburetor body 14 and the cover 30. The metering diaphragm 40 may engage a lever 48 that may be considered part of the valve 42, and may control opening and closing of the valve 42 as the diaphragm flexes due to a pressure differential across the diaphragm, as is known in the art.

The cover 30 may include one or more plates that overlie the metering diaphragm 40 and, with the reference side 46 of metering diaphragm 40, define a metering reference chamber 50. In the example shown, the cover 30 includes two plates with an inner plate 52 coupled to the carburetor body 14 and an outer plate 54 coupled to the inner plate 52. The purge/primer assembly 31 may be carried by the outer plate 54 and include a flexible bulb 56 that may be depressed to pump fluids from and within the carburetor 10, as is known in the art.

On its inner side, adjacent to the carburetor body 14, the inner plate 52 may include recess 62 that defines part of the reference chamber 50. The reference chamber 50 may be vented to the atmosphere or to another source, such as an air filter or any point upstream of the choke valve, by a vent 64 (FIG. 3). The vent 64 may be provided by a simple port in the inner plate 52 that is open to the environment/atmosphere, or it could be provided by a passage that vents the metering reference chamber 50 to a predetermined location or area. As shown in FIG. 3, a vent port 66 leads to a tube 68 that may be coupled to a different tube or left open, as desired. The vent port 66 or a restriction somewhere in the vent path may be sized to control the rate of air flow therethrough, if desired.

A fluid pump 70 may be carried by the cover 30 and adapted to communicate with the fuel metering diaphragm 40 to alter the operation of the fuel metering diaphragm 40 in at least certain engine operating conditions. The fluid pump 70 may include an actuator, such as a pump diaphragm 72 trapped about its periphery between the inner and outer plates 52, 54. As shown in FIGS. 1 and 2, a pump chamber 74 may be defined between an outer side of the inner plate 52 and the pump diaphragm 72. To facilitate flexing of the pump diaphragm 72 and permit the volume of the pump chamber 74 to vary, a cavity 78 may be provided in the outer side of the inner plate 52. And the pump chamber 74 may be in fluid communication with the metering reference chamber 50 through an outlet, which may be a port or passage 80 (as representative examples) in the inner plate 52. Of course, a conduit or tube could also be used to communicate the chambers with a passage that extends partially outside of the carburetor body, if desired.

A second cavity 82 may be provided in an inner surface of the outer plate 54. A pump reference chamber 86 is defined in part by the second cavity 82 and between the outer plate 54 and the pump diaphragm 72. Finally, a biasing member, such as a spring 88, may act on the pump diaphragm 72 and yieldably bias the diaphragm 72 to a first position, as shown in FIG. 1. In the implementation shown, the spring 88 axes the pump diaphragm 72 into the pump chamber 74 to reduce the volume of the pump chamber 74 absent a pressure in the pump reference chamber 86 tending to counteract the spring 88 and flex the diaphragm 72 in a direction that increases the volume of the pump chamber 74. In the drawings, a central, flexible portion 89 of the pump diaphragm 72 is generally cup-shaped, not shown in section, and a portion of the spring 88 is hidden from view by the diaphragm. An end of the spring 88 may engage the diaphragm at the bottom of the cup or central portion 89. To prevent wear on the diaphragm a plate of a different material may be provided between the spring and diaphragm. The other end of the spring 88 may engage the outer plate 54.

To actuate the pump diaphragm 72, a pressure signal passage 90 is provided that communicates a pressure source with the pump reference chamber 86. In the implementation shown, the pressure signal passage 90 includes aligned passages extending from the air-fuel passage 16 to the pump reference chamber 86 and extending through the carburetor body 14, inner plate 52 and into the outer plate 54. The passage 90 may also extend through aligned ports in the periphery of one or both of the fuel metering diaphragm 40 and pump diaphragm 72, in areas where those diaphragms are trapped between opposed bodies so that the pressure signal passage 90 does not communicate with either the fuel metering chamber 28, metering reference chamber 50 or the pump chamber 74. Any or all of the pressure signal passage 90 could extend outside of the carburetor body 14 and inner plate 52, such as by one or more hoses or tubes, as desired.

Accordingly, the pressure signal source in the implementation shown is engine pressure pulses that are routed from the air-fuel passage 16 to the pump reference chamber 86 through the pressure signal passage 90. The subatmospheric pressure pulses reduce the pressure within the pump reference chamber 86 and provide a force on the pump diaphragm 72 tending to displace the diaphragm 72 against the force of the spring 88. When the pressure within the pump reference chamber 86 is low enough, the pump diaphragm 72 will be displaced against the spring force thereby reducing the volume of the pump reference chamber 86 and increasing the volume of the pump chamber 74. A subsequent increase in pressure in the pump reference chamber 86 would then allow the pump diaphragm 72 to return toward its first position, decreasing the pump chamber 74 volume and displacing fluid (air) into the metering reference chamber 50. Accordingly, the system (e.g. the spring 88 and flexibility of the pump diaphragm 72) can be calibrated so that a desired pressure signal is needed to actuate the pump 70 so that the pump 70 is actuated when desired. For example, the pump 70 may be actuated during only certain engine operating conditions to augment the fuel supplied from the carburetor 10 and support the engine during, for example, engine acceleration.

In operation, the metering diaphragm 40 moves in response to pressure differentials to actuate the metering valve 42. In the illustrated embodiment, a reference pressure (e.g., atmospheric pressure) acts upon the reference side 46 of the metering diaphragm 40, and fluid pressure in the metering chamber 28 acts upon the chamber side 44 of the metering diaphragm 40. As air flows from the atmosphere and through the air-fuel passage 16 to be mixed with fuel on its way to the engine, the pressure in the air-fuel passage 16 and the metering chamber 28 falls below the reference pressure as fuel is delivered from the metering chamber 28 to the passage 16. The metering diaphragm 40 flexes in a direction that decreases the volume of the chamber 28 to open the metering valve 42 and allow fuel to flow from fuel source 18 and into the chamber 28. When the pressure in metering chamber 28 is equalized with and/or exceeds the pressure in the metering reference chamber 50 due to the newly introduced filet in the metering chamber 28, the metering diaphragm 40 moves in the opposite direction, and the metering valve 42 closes until metering chamber pressure again falls below the reference pressure as fuel is provided from the metering chamber 28 to the air-fuel passage 16. Thus, every time a dose of fuel is delivered from the metering chamber 28 to the air-fuel passage 16, the metering valve 42 is opened to refill the metering chamber 28 then closed again until the next dose of fuel is delivered to passage 16.

To alter operation of the fuel metering system 12, the pressure in the metering reference chamber 50 and acting on the metering diaphragm 40 can be altered. In the implementation shown, the pressure in the metering reference chamber 50 is altered by providing an air flow into the metering reference chamber 50 from the pump 70. As noted above, when a sufficiently low pressure exists in the pump reference chamber 86, the pump diaphragm 72 is displaced against its spring 88 which increases the volume of the pump chamber 74, as shown in FIG. 2. Thereafter, when the pressure increases in the pump reference chamber 86 the pump diaphragm 72 returns towards its normal, first position and at least some of the air in the pump chamber 74 is displaced into the metering reference chamber 50. A sufficiently low pressure may be communicated with the pump reference chamber 86 when the engine is operating at or near idle. Hence, at idle (and perhaps an off-idle starting or warming-up position of the throttle valve 32) the pump diaphragm 72 may be displaced against its spring 88 to increase the volume of the pump chamber 74. Thereafter, when the throttle valve 32 is rotated to or sufficiently toward its wide open position, the pressure in the pressure signal passage 90 and pump reference chamber 86 will increase and the pump diaphragm 72 will return toward its first position thereby displacing at least some of the air in the pump chamber 74 to the metering reference chamber 50.

The air pumped to the metering reference chamber 50 will temporarily increase the pressure in the metering reference chamber 50 and cause the metering system 12 to deliver extra fuel to the air-fuel passage 16 and then to the engine. The extra fuel delivered to the engine will support engine acceleration from idle to wide open throttle, or some throttle position between idle and wide open. After being pumped, the air may be vented through port 66 to enable the metering reference chamber 50 to return to its reference pressure and normal operation. While the throttle valve 32 remains sufficiently open (that is, sufficiently away from its idle position) the pressure in the pump reference chamber 86 will not be low enough to displace the pump diaphragm 72 and the pump diaphragm 72 will remain in or sufficiently near its first position so that air is not pumped by the pump 70. The metering system 12 functions in its normal manner in this situation. Of course, each time the throttle valve 32 returns to or sufficiently toward its idle position, the subatmospheric pressure in the pressure signal passage 90 and pump reference chamber 86 may again be sufficient to displace the pump diaphragm 72 to or toward its second position (FIG. 2), to support any subsequent acceleration with additional fuel delivered to the engine as noted above.

In addition, because the pump 70 is actuated by engine pressure pulses, the pump 70 may also be actuated at times other than during engine acceleration from idle, such as during starting of the engine. As the engine is cranked for starting, sufficiently high negative or subatmospheric pressure signal(s) may be communicated with the pump reference chamber 86 to temporarily displace the pump diaphragm 72. In this manner, the pump diaphragm 72 may be actuated (moved toward its second position and back toward its first position) one or more times as an engine is initially started, and may provide one or more bursts of air to the metering reference chamber 50 which may cause the metering system 12 to provide additional fuel into the air-fuel passage 16 to facilitate starting and initial operation of the engine.

Accordingly, a pump 70 may alter a differential pressure across and acting on a metering diaphragm 40 in accordance with or as a function of certain engine operating conditions. In the implementation shown, the pump 70 provides an increased pressure in the metering reference chamber 50 to cause the carburetor metering system 12 to provide an increased amount of fuel to an engine after a sufficiently low pressure signal provided to the pump 70 no longer exists or its pressure is increased. This may happen during different engine operating conditions, such as during acceleration from idle and/or during engine starting. The pump 70 may conveniently be carried by a cover 30 for the metering system 12, and at least partially carried by a plate 52 that defines a reference chamber 50 for the fuel metering diaphragm 40. In this way, the communication between the pump 70 and the metering system 12 can be simplified with short internal and/or external passages or tubes and the like. And the assembly can be relatively compact size. Further, the pump 70 can be added to existing carburetors by swapping out an existing fuel metering diaphragm cover with a cover 30 including the pump 70.

Further, the pump 70 may be carried by the carburetor other than at the cover 30 for the metering system 12. For example, the pump 70 may be carried by or adjacent to a different surface of the carburetor body, or by or at a different plate or component of the carburetor body. Representative examples include at or on a cover for a fuel pump assembly of the carburetor with internal and/or external passages communicating the pump chamber 74 with the metering reference chamber 50. The pump 70 could also be carried by a side or other surface of the carburetor body 14 separate from the fuel pump and fuel metering system, as desired. In at least some implementations, a portion of the pump chamber 74 may be defined in the same piece of material as another portion or component integral with the carburetor 10 such that the pump and carburetor can be considered a single unit or assembly. By way of non-limiting examples, a portion or component integral with the carburetor may include either cover for the metering system 12 or fuel pump or a surface of the carburetor body 14, and in this way, these components may serve a dual purpose providing their normal function on the carburetor and also defining and/or carrying part of the fluid pump 70. The pump could also be carried by a component adjacent to the carburetor such as a bracket, the engine, an engine support, or an air filter assembly. In at least some implementations, the pump 70 may be carried by a component, such as an air filter assembly, that is upstream of the carburetor, where upstream is defined relative to fluid flow into and through the carburetor. Of course, in general terms, the pump 70 may be located anywhere that the pump can receive a pressure signal input and provide an output to at least temporarily affect the pressure within the metering reference chamber 50.

If desired, a valve 100 (shown diagrammatically in FIG. 1) optionally could be provided to prevent or inhibit an engine pressure signal from being communicated with the pump reference chamber 86 during any engine operating condition and/or at any time. This could be accomplished by blocking the pressure signal passage 90, or venting the passage 90 or pump reference chamber 86 sufficiently such that the pump diaphragm 72 is not actuated. In this manner, the pump 70 could be used for only certain engine operating conditions and not others, if and as desired. The valve 100 could be mechanical or electrical (e.g. a solenoid actuated valve) and manually or automatically actuated, e.g. via use of a solenoid valve driven by a controller or other electric signal source. One representative example of a valve that could be used in this assembly is set forth in U.S. Pat. No. 7,467,785, the disclosure of which is incorporated herein by reference in its entirety.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A carburetor that provides a supplemental fuel supply to an engine, comprising:

a body having an air-fuel passage from which a fuel and air mixture flows from the carburetor, and a fuel metering chamber from which fuel flows to the air-fuel passage;

a fuel metering diaphragm defining part of the fuel metering chamber and having at least a portion that is movable relative to the body to increase and decrease the volume of the fuel metering chamber to control fuel flow in the fuel metering chamber, the fuel metering diaphragm also defining part of a metering reference chamber that is separate from the fuel metering chamber; and a fluid pump carried by the carburetor or carried by another component upstream of the carburetor relative to the direction of air flow through the carburetor and having a pump chamber with an an outlet in fluid communication with the metering reference chamber and an actuator arranged to discharge air through the outlet to increase the air pressure within the metering reference chamber and thereby increase the fuel flow rate from the fuel metering chamber into the air-fuel passage to provide a supplemental fuel supply to the engine.

2. The carburetor of claim 1 wherein the body includes a pressure signal passage communicating an engine pressure signal with the actuator, and the actuator includes a pump diaphragm that defines part of the pump chamber and is displaced from a first position by the pressure signal to increase the volume of the pump chamber during at least one operating condition and to provide a volume of air to the metering reference chamber when the pump diaphragm returns toward its first position.

3. The carburetor of claim 2 which also includes a vent in communication with the metering reference chamber and pump chamber.

4. The carburetor of claim 1 which also includes a vent in communication with the metering reference chamber and pump chamber.

5. A carburetor that provides a supplemental fuel supply to an engine, comprising:

a body having an air-fuel passage from which a fuel and air mixture flows from the carburetor, and a fuel metering chamber from which fuel flows to the air-fuel passage;

a fuel metering diaphragm defining part of the fuel metering chamber and having at least a portion that is movable relative to the body to increase and decrease the volume of the fuel metering chamber to control fuel flow in the fuel metering chamber, the fuel metering diaphragm also defining part of a metering reference chamber that is separate from the fuel metering chamber;

a fluid pump carried by the carburetor or carried by another component upstream of the carburetor relative to the direction of air flow through the carburetor and having an outlet in fluid communication with the metering reference chamber and an actuator arranged to discharge fluid through the outlet to increase the pressure within the metering reference chamber and thereby increase the fuel flow rate from the fuel metering chamber to the air-fuel passage to provide a supplemental fuel supply to the engine;

a pressure signal passage in the body and communicating an engine pressure signal with the actuator, the actuator includes a pump diaphragm that defines part of a pump chamber and is displaced from a first position by the pressure signal to increase the volume of the pump chamber during at least one operating condition and to provide a volume of fluid to the metering reference chamber when the pump diaphragm returns toward its first position;

a biasing member that yieldably biases the pump diaphragm toward its first position and wherein the pressure signal passage provides a subatmospheric pressure signal to a side of the pump diaphragm opposite the pump chamber to increase the volume of the pump chamber at least at idle engine operation.

6. The carburetor of claim 5 wherein the biasing member provides a force on the pump diaphragm that is greater than any subatmospheric pressure signal provided on the pump diaphragm through the pressure signal passage when the engine is operating at wide open throttle.

7. The carburetor of claim 5 wherein the fluid pump is carried by a cover that defines part of the metering reference chamber.

8. A carburetor that provides a supplemental fuel supply to an engine, comprising:

a body having an air-fuel passage from which a fuel and air mixture flows from the carburetor, and a fuel metering chamber from which fuel flows to the air-fuel passage;

a fuel metering diaphragm defining part of the fuel metering chamber and having at least a portion that is movable relative to the body to increase and decrease the volume of the fuel metering chamber to control fuel flow in the fuel metering chamber, the fuel metering diaphragm also defining part of a metering reference chamber that is separate from the fuel metering chamber;

a fluid pump carried by the carburetor or carried by another component upstream of the carburetor relative to the direction of air flow through the carburetor and having an outlet in fluid communication with the metering reference chamber and an actuator arranged to discharge fluid through the outlet to increase the pressure within the metering reference chamber and thereby increase the fuel flow rate from the fuel metering chamber to the air-fuel passage to provide a supplemental fuel supply to the engine;

a pressure signal passage in the body and communicating an engine pressure signal with the actuator, and the actuator includes a pump diaphragm that defines part of a pump chamber and is displaced from a first position by the pressure signal to increase the volume of the pump chamber during at least one operating condition and to provide a volume of fluid to the metering reference chamber when the pump diaphragm returns toward its first position; and a valve that selectively inhibits or prevents communication of the pressure signal with the pump diaphragm.

9. The carburetor of claim 8 wherein the valve is mechanically actuated.

10. The carburetor of claim 8 wherein the valve is electrically actuated.

11. A carburetor that provides a supplemental fuel supply to an engine, comprising:

a body having an air-fuel passage from which a fuel and air mixture flows from the carburetor, and a fuel metering chamber from which fuel flows to the air-fuel passage;

a pressure signal passage through which an engine pressure signal source is routed;

a fuel metering diaphragm defining part of the fuel metering chamber, and defining part of a metering reference chamber that is separate from the fuel metering chamber, the fuel metering diaphragm having a portion that moves relative to the body; and a pump diaphragm carried by the carburetor to define, with a portion of the carburetor body or another component of the carburetor, a pump chamber on one side of the pump diaphragm and a reference chamber on the opposite side of the pump diaphragm that is communicated with the pressure signal passage, wherein the pump chamber has an outlet that is in fluid communication with the metering reference chamber and the pump diaphragm is flexed in response to a pressure signal from the pressure signal passage to vary the volume of the pump chamber and selectively move air from the pump chamber through the outlet to increase the pressure within the metering reference chamber and thereby increase the fuel flow rate from the fuel metering chamber to the air-fuel passage.

12. The carburetor of claim 11 which also includes a vent in communication with the metering reference chamber and pump chamber.

13. A carburetor that provides a supplemental fuel supply to an engine, comprising:

a body having an air-fuel passage from which a fuel and air mixture flows from the carburetor, and a fuel metering chamber from which fuel flows to the air-fuel passage;

a pressure signal passage through which an engine pressure signal source is routed;

a fuel metering diaphragm defining part of the fuel metering chamber, and defining part of a metering reference chamber that is separate from the fuel metering chamber, the fuel metering diaphragm having a portion that moves relative to the body;

a pump diaphragm carried by the carburetor to define, with a portion of the carburetor body or another component of the carburetor, a pump chamber on one side of the pump diaphragm and a reference chamber on the opposite side of the pump diaphragm that is communicated with the pressure signal passage, wherein the pump chamber has an outlet that is in fluid communication with the metering reference chamber and the pump diaphragm is flexed in response to a pressure signal from the pressure signal passage to vary the volume of the pump chamber and selectively move air from the pump chamber through the outlet to increase the pressure within the metering reference chamber and thereby increase the fuel flow rate from the fuel metering chamber to the air-fuel passage; and a biasing member that yieldably biases the pump diaphragm toward its first position and wherein the pressure signal passage provides a subatmospheric pressure signal to a side of the pump diaphragm opposite the pump chamber to increase the volume of the pump chamber at least at idle engine operation.

14. The carburetor of claim 13 wherein the biasing member provides a force on the pump diaphragm that is greater than any subatmospheric pressure signal provided on the pump diaphragm through the pressure signal passage when the engine is operating at wide open throttle.

15. The carburetor of claim 13 wherein the fluid pump is carried by a cover that defines part of the metering reference chamber.

16. The carburetor of claim 13 which also includes a vent in communication with the metering reference chamber and pump chamber.

17. A carburetor that provides a supplemental fuel supply to an engine, comprising:

a body having an air-fuel passage from which a fuel and air mixture flows from the carburetor, and a fuel metering chamber from which fuel flows to the air-fuel passage;

a pressure signal passage through which an engine pressure signal source is routed;

a fuel metering diaphragm defining part of the fuel metering chamber, and defining part of a metering reference chamber that is separate from the fuel metering chamber, the fuel metering diaphragm having a portion that moves relative to the body;

a pump diaphragm carried by the carburetor to define, with a portion of the carburetor body or another component of the carburetor, a pump chamber on one side of the pump diaphragm and a reference chamber on the opposite side of the pump diaphragm that is communicated with the pressure signal passage, wherein the pump chamber has an outlet that is in fluid communication with the metering reference chamber and the pump diaphragm is flexed in response to a pressure signal from the pressure signal passage to vary the volume of the pump chamber and selectively move air from the pump chamber through the outlet to increase the pressure within the metering reference chamber and thereby increase the fuel flow rate from the fuel metering chamber to the air-fuel passage; and a valve that selectively inhibits or prevents communication of the pressure signal with the actuator.

18. The carburetor of claim 17 wherein the valve is mechanically actuated.

19. The carburetor of claim 17 wherein the valve is electrically actuated.

* * * * *